United States Patent [19]

Feretto

[11] 4,067,077

[45] Jan. 10, 1978

[54] CIRCULAR WATERBED

[76] Inventor: Fredrick R. Feretto, 2905 San Pablo Dam Road, El Sobrante, Calif. 94803

[21] Appl. No.: 616,777

[22] Filed: Sept. 25, 1975

[51] Int. Cl.[2] ..... A47C 27/08

[52] U.S. Cl. ..... 5/365

[58] Field of Search ..... 5/248 WB, 365–371

[56] References Cited

U.S. PATENT DOCUMENTS

| | | | |
|---|---|---|---|
| 3,123,117 | 3/1964 | Nourse et al. | 5/348 WB |
| 3,732,585 | 5/1973 | Krehbiel | 5/348 WB |
| 3,778,852 | 12/1972 | Penn et al. | 5/348 WB |
| 3,787,907 | 1/1974 | Pennington | 5/348 WB |
| 3,838,470 | 10/1974 | May | 5/348 WB |
| 3,849,814 | 11/1974 | Ross | 5/370 |

*Primary Examiner*—Paul R. Gilliam
*Assistant Examiner*—Victor N. Sakran

[57] ABSTRACT

A self supporting circular waterbed comprising a circular inflatable bag installed within a soft endless flexible band. Pressure from within the inflated bag against the soft flexible band, stiffens and rigidifies the band which then functions as a conventional type frame with added advantages.

9 Claims, 5 Drawing Figures

CIRCULAR WATERBED

BACKGROUND OF INVENTION

My invention relates to a waterbed and more particularly to an improved waterbed of circular configuration and its supporting structure.

Conventional waterbeds, in general, must rely on rigid in flexible peripheral forms, or built in peripheral pneumatic air chambers to provide support for the soft inflatable water bags installed in such frames. Rigid inflexible forms are generally bulky, expensive and difficult to package and convey, and air chambers, while easier to package are expensive to manufacture.

OBJECTS

Among the objects of my invention are:

1. To provide a novel and improved waterbed;
2. To provide a novel and improved waterbed which lends itself to be conveniently merchandised in the form of a kit;
3. To provide a novel and improved waterbed which can be readily set up by the purchaser;
4. To provide a novel and improved waterbed of circular configuration which requires no independent self-sustaining rigid frame;
5. To provide a novel and improved waterbed of circular configuration wherein the inflated water bag imparts the rigidity to the frame.

Additional objects of the invention will be brought out in the following description of a preferred embodiment of the same, taken in conjunction with the accompanying drawings, wherein FIG. 1 is a collapsed view of a water bag.

Figure 1:
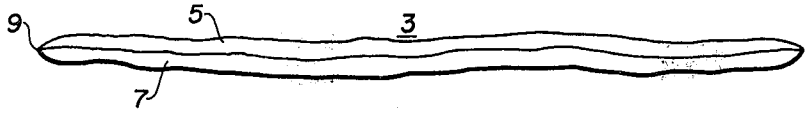
Figure 2:
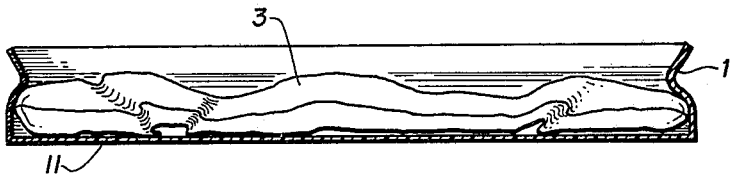
FIG. 2 is a view, partly in section, illustrating the water bag of FIG. 1 inserted into a soft endless band as a first step in assembling the waterbed of the present invention.
Figure 3:
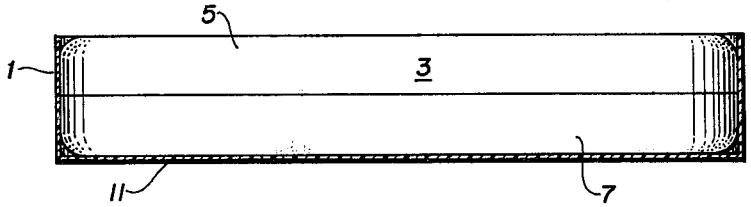
FIG. 3 is a view, partly in section, of the water bed as completed assembled.

Broadly the invention involves a waterbed, preferbly of circular configuration wherein the frame is a band of flexible material rigidified by the bag when inflated.

For details, reference will be had to the accompanying drawings wherein the bed illustrated, is of circular configuration and comprises basically, a soft, endless and uninflatable flexible band 1 of substantially non-stretchable material, such as a plastic having minimum stretch characteristics, as "Herculon" for example.

This band is of a height comparable to a conventional bed frame and expandable from a folded or collapsed condition to a predetermined desired diameter without stretch.

The bag 3 may be of a conventional type, but preferably formed of upper and lower waterproof sheets 5 and 7 respectively, joined peripherally in a single seam 9, the diameter of the bag, in its uninflated condition, exceeding that of the band in its expanded condition.

When said larger diameter bag is installed within the flexible band and then inflated, as by filling with water, pressures developed within the bag will expand, stiffen and rigidify the soft flexible band. A sheet 11 of soft flexible waterproof material joined peripherally by a waterproof seam, along the lower edge of the flexible band, provides a floor for a resulting catch basin for water in the event of a leak or rupture of the bag, as well as to facilitate retention and preclude the escape of the bag from beneath the flexible band as the bag inflates.

When once set up and ready for use, the flexible band will have been sufficiently rigidified to perform the functions of a solid, inherently rigid frame, and with added advantages.

It retains flexibility, whereby, in response to the weight of an individual sitting on the edge of the bed, the band in free to bend inwardly or outwardly, such outwardly bending being made possible by a compensating inwardly bending of the band at a diametrically opposite location. Consequently, the individual is not exposed to the pressure of hard edges and sharp corners presented by conventional hard frames.

The band may be rendered decorative by an imprinted pattern, or by application thereto, of a covering of fir or other decorative material.

The invention is best applied to and from a practical standpoint, restricted to beds of circular configuration, since a circular band will respond uniformly to the inflation pressures developed within the bag and there will be no tendency for distorting the contour of the bed from its intended shape.

The bed may be readily and conveniently merchandized in kit form, to be set up for use, by the purchaser, simply by inserting the bag within its band and adding the necessary water to inflate the bag, and when so set up, offers the conveniences noted above.

Figure 4:
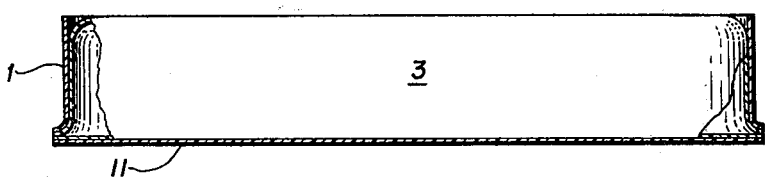
FIG. 4 is a view, partly in section, of a modification of the invention as depicted in FIG. 3.
Figure 5:
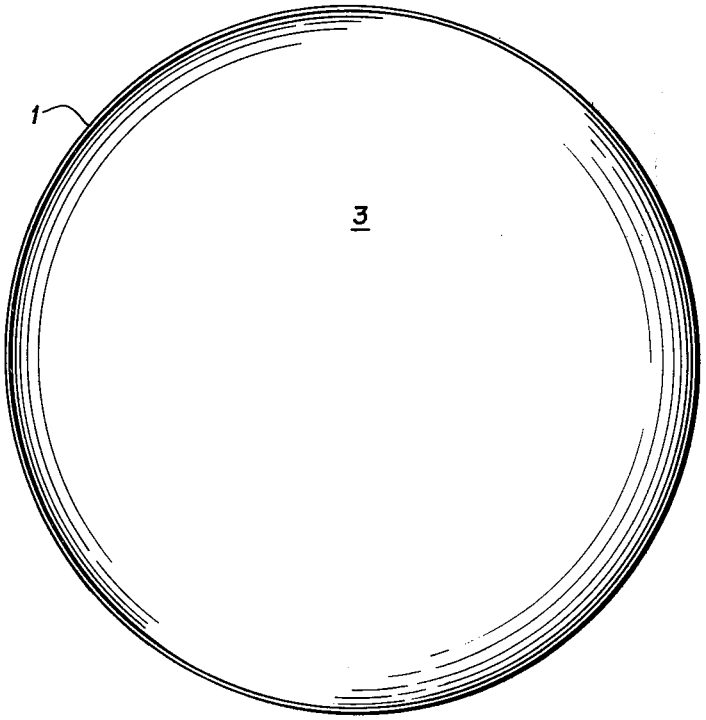
FIG. 5 is a plan view of the waterbed of the preceeding figures.

As a convenient modification of the above described embodiment, the bag may be altered to permit it to be sewn, in its installed position, along the lower edge of the band with the floor 11 of the catch basin, such modification being depicted in FIG. 4 of the drawings.

Accordingly, while I have illustrated and described the invention in its preferred form and in considerable detail, the same is subject to alteration and modification without departing from the underlying principles involved, and I do not desire to be limited in my protection to the specific details described except as may be necessitated by the appended claims.

I claim:

1. A circular waterbed kit comprising a soft, endless, flexible band of material of minimal stretchability, unfoldable from a relaxed condition to a circle having a predetermined diameter, and a circular inflatable bag having a diameter in its uninflated condition exceeding that of said soft flexible band in its unfolded condition, whereby upon installing said bag, in its uninflated condition, within said flexible band and then inflating said bag, said band will confine said bag and cause said bag to stiffen said band in response to pressure developed in said bag.

2. A circular waterbed kit in accordance with claim 1, wherein a sheet of soft, flexible, waterproof material joins said soft endless flexible band substantially along the lower edge of said band, to form with said band, a catch basin in the event of loss of water from said inflatable bag when in use, and to preclude escape of said bag beneath the lower edge of said band during inflation of said bag and thereafter while said bed is in use.

3. A circular waterbed kit in accordance with claim 1, wherein said inflatable bag includes an upper and lower sheet of waterproof material joined together along a single seam.

4. A circular waterbed kit as in claim 2, wherein said inflatable bag includes an upper and lower sheet of waterproof material joined together along a single seam.

5. A circular waterbed comprising a soft endless flexible band of material of minimal stretchability, unfoldable from a relaxed condition to a circle having a predetermined diameter, and a circular inflatable bag of a diameter in its uninflated condition, exceeding that of said flexible band in its unfolded condition, said circular inflatable bag being installed within said band and inflated, whereby, because of said diameter relationship, internal pressures developed in said bag when inflated, will cause said bag to stiffen and rigidify said flexible band of material of minimal stretchability.

6. A circular waterbed in accordance with claim 5, wherein a sheet of soft, flexible, waterproof material joins with said soft, endless, flexible band, substantially along the lower edge of said band, to form a catch basin in the event of loss of water from said inflatable bag when in use, and to preclude escape of said bag beneath the lower edge of said band.

7. A circular waterbed in accordance with claim 5, wherein said inflatable bag includes an upper and lower sheet of waterproof material joined together along a single seam.

8. A circular waterbed in accordance with claim 5, wherein said circular inflatable bag is joined peripherally with said soft endless flexible band along substantially the lower edge of said band.

9. A method of fabricating a substantially circular waterbed comprising forming an endless band of non-rigid material of minimal stretchability having a predetermined diameter when unfolded from a folded or collapsed condition to a circular form, forming a circular inflatable bag having a diameter in its uninflated condition, exceeding that of said band in its unfolded condition, installing said bag in its uninflated condition within said band of non-rigid material of minimum stretchability, and inflating said bag to substantially uniformly transit internally developed pressure to said band to stiffen and rigidify the same.

* * * * *